US010562086B2

(12) United States Patent
Yanai et al.

(10) Patent No.: US 10,562,086 B2
(45) Date of Patent: Feb. 18, 2020

(54) HYDRAULIC SCREW-DOWN DEVICE USED IN SMALL-SIZE ROLLING MILL OR ROLL PRESS MACHINE AND HYDRAULIC CONTROL METHOD USING THE SAME

(71) Applicant: Oono-roll Corporation, Hitachiomiya-shi, Ibaraki (JP)

(72) Inventors: Katsuhiko Yanai, Hitachiomiya (JP); Shigeru Mori, Hitachi (JP)

(73) Assignee: Oono-roll Corporation, Hitachiomiya-shi, Ibaraki (JP)

( * ) Notice: Subject to any disclaimer, the term of this patent is extended or adjusted under 35 U.S.C. 154(b) by 644 days.

(21) Appl. No.: 15/335,786

(22) Filed: Oct. 27, 2016

(65) Prior Publication Data

US 2017/0232491 A1 Aug. 17, 2017

(30) Foreign Application Priority Data

Feb. 17, 2016 (JP) ..... 2016-027575

(51) Int. Cl.
*B21B 31/32* (2006.01)
*B21B 37/62* (2006.01)

(52) U.S. Cl.
CPC ..... *B21B 31/32* (2013.01); *B21B 37/62* (2013.01)

(58) Field of Classification Search
CPC ..... B21B 31/32; B21B 31/24; B21B 31/20; B21B 37/60; B21B 37/62
See application file for complete search history.

(56) References Cited

U.S. PATENT DOCUMENTS 3,559,432 A * 2/1971 Rasteli ..... B21B 31/32 72/13.3
4,484,443 A * 11/1984 Takigawa ..... B21B 37/62 60/534

FOREIGN PATENT DOCUMENTS

JP 2-14123 B2 4/1990
JP 2-97906 U 8/1990
JP 4299229 B2 4/2009

* cited by examiner

*Primary Examiner* — Debra M Sullivan
(74) *Attorney, Agent, or Firm* — Daniel J. Stanger

(57) ABSTRACT

In a small-size rolling mill or a roll press machine, to provide a hydraulic screw-down device compatible with the plate thickness accuracy without using a hydraulic control servo valve.

A hydraulic screw-down device that is comprised of a screw to move a piston arranged in a booster cylinder back and forth, and a motor that gives rotational force to the screw controlling freely the rotational angle of the screw so as to move the piston to the purpose position. A screw-down cylinder connected with the booster cylinder through piping makes a ram in the screw-down cylinder move vertically by the move of oil caused by the movement of the piston in the booster cylinder and thereby enables push-up and push-down of the mill roll.

13 Claims, 7 Drawing Sheets

PRIOR ART

HYDRAULIC SCREW-DOWN DEVICE USED IN SMALL-SIZE ROLLING MILL OR ROLL PRESS MACHINE AND HYDRAULIC CONTROL METHOD USING THE SAME

TECHNICAL FIELD

The present invention relates to a hydraulic screw-down device suitable for a small-size rolling mill or a roll press machine having a roll force of 500 tons or less, and a hydraulic control method using the same.

BACKGROUND

Wide steel plates like those materials that are used in the body of automobiles are produced by major steelmaking companies in large quantities. A steelmaking company uses plural rolling mills aligned in tandem; steel sheet passes between wide mill rolls to be rolled by a large force of 1000 tons or more for reduction of its thickness. Such mass-production-oriented rolling mill employs, for efficient rolling, mostly a hydraulic screw-down apparatus consisting of a hydraulic servo control valve and a hydraulic jack as a means for generating a large roll force between the mill rolls. In recent years, in the fields of roll press machines for continuous roll-pressing of new materials and for rolling non-ferrous material to foil thinly, use of a hydraulic screw-down device that uses hydraulic pressure has increased for more enhanced plate thickness accuracy of the rolled material after rolling process.

When introducing the hydraulic screw-down device that uses hydraulic pressure into a small-size rolling mill, the roll-gap regulating movement of mill rolls has to be controlled finely; therefore, it is necessary to use a hydraulic servo control valve that is able to take in or put out a minute amount of oil. For a stable use of a hydraulic servo control valve, the oil temperature of the hydraulic pressure generating apparatus for supplying a high-pressure hydraulic pressure has to be maintained constant. It is, therefore, necessary to provide such a system that is required in a large rolling mill like a cooling water supply infrastructure for cooling the oil in the hydraulic tank. For simplifying a hydraulic screw-down system, apparatuses below-listed are disclosed.

Patent Literature 1 describes a plate thickness control. According to the description, the rod end of an intermediate cylinder is inserted in a main cylinder, and the plate thickness is controlled by raising or lowering the position of the ram of the main cylinder with hydraulically regulating the position of the rod of the intermediate cylinder.

Patent Literature 2 describes a configuration such that intermediate cylinders are provided and each of them is connected severally to each of both main cylinders incorporated in the driving side and the working side of a rolling mill, and two intermediate cylinders are connected by a rod. Further, a servo control valve is connected on one end of the intermediate cylinder to raise or lower the rams of the working side and the driving side of the main cylinder at the same speed.

Patent Literature 3 describes an ultrahigh-pressure generator that is configured with a movement-mechanism of threaded rod and spirality device, and hydraulic piston and cylinder.

LITERATURE OF RELATED ART

Patent Literature

[Patent Literature 1] Japanese Utility Model Application Laid-open No. H02-97906

[Patent Literature 2] Japanese Examined Patent Application Publication No. H02-14123

[Patent Literature 3] Japanese Patent No. 4299229

SUMMARY OF INVENTION

Technical Problem

The hydraulic screw-down mechanisms described in Patent Literatures 1 and 2 are to be employed in large-size rolling mills; such mechanisms are not suitable for screw-down mechanisms for rolling mills. The hydraulic screw-down mechanism described in Patent Literature 3 generates ultrahigh-pressure and is able to perform a precise position control. However, the literature does not mention that the described mechanism is capable of functioning as a screw-down device for a small-size rolling mill.

An object of the present invention is to provide a hydraulic screw-down device that is able to control the mill roll position highly accurately in a small-size rolling mill and a roll press machine each having a roll force of maximum 500 tons or less, without using a mechanical contrivance that relies on a worm gear reducer or a hydraulic control mechanism that uses a hydraulic servo control valve, wherein the hydraulic screw-down device is intended to allow eased mounting on a rolling mill or on a roll press machine, in particular on a small-size rolling mill, and to allow performing hydraulic control easily.

Means for Solving Problem

An A-hydraulic circuit that allows vertical movement of the ram of a screw-down cylinder incorporated in a housing by the pressure oil from a hydraulic pump at a more fast speed, and a B-hydraulic circuit that connects the screw-down cylinder and a booster cylinder are provided, wherein the A-hydraulic circuit and the B-hydraulic circuit are joined in a T-shape.

A pilot check valve is installed on the A-hydraulic circuit, and a mechanism, which confines high-pressure oil between the screw-down cylinder and the booster cylinder by closing the pilot check valve, is provided. Further, the booster cylinder has a piston in its cylinder and the piston is connected to a rod that is allowed to move back and forth by a screw. The movement of the piston pressurizes the pressure oil confined between the piston and the cylinder, and, at the same time, pressurizes the pressure oil confined between the booster cylinder and the screw-down cylinder, allowing generating a force proportional to the difference of pressure-receiving areas between both the cylinders. Thereby, a stronger force is produced finally between the upper and the lower rolls via the screw-down cylinder.

Further, the hydraulic screw-down device is comprised of a screw for moving the piston provided in the booster cylinder back and forth, and a motor that gives a rotational force to the screw to control freely the rotational angle of the screw to move the piston to the purpose position. The screw-down cylinder, which has a connection via piping from the booster cylinder, has such a mechanism as is able to raise or lower the mill roll by vertically moving the ram in the screw-down cylinder by the movement of the high-pressure oil caused by the movement of the piston in the booster cylinder.

A work method is provided. The method is able to improve, in a short time, an existing rolling mill to such a rolling mill equipment as has a hydraulic screw-down function. In the method, the screw-down screw of the electric screw-down apparatus incorporated in an existing mill stand is removed, the screw-down cylinder is inserted in a cylindrical recess in which the screw-down screw of the mill stand was incorporated, and the booster cylinder arranged on the top of the mill stand and the screw-down cylinder arranged at the upper part of the mill stand are connected with piping.

The pressure of the oil column on the head side of the booster cylinder is made increased by adding the pressure of the rod side to the pressure of the head side produced by the screw, wherein the pressure addition is occurred by connecting the oil pressure pressurized by an accumulator to the oil column on the rod side of the booster cylinder.

The present invention provides a hydraulic screw-down device of a rolling mill or of a roll press machine. In concrete terms, the invention is characterized in that, in a screw-down device of a rolling mill that rolls a steel plate as a material to be rolled with a roll, or of a roll press machine that presses a material with a roll, the rolling or the pressing is performed by giving roll force or pressing force between the upper and the lower rolls by moving vertically the ram of a screw-down cylinder incorporated in the housing of the rolling mill or the roll press machine by the pressure oil from a hydraulic pump.

The hydraulic screw-down device is comprised of a booster cylinder;

a piston incorporated in the booster cylinder;

a rod connected with the piston;

a controlling driver device comprising a driver for driving the rod and a controlling driver motor, which is connected with the driver, for controlling the range of piston movement;

an A-hydraulic circuit, which has a pilot check valve, for moving the ram vertically by the pressure oil;

and a B-hydraulic circuit, which is connected with the A-hydraulic circuit, for connecting the screw-down cylinder and the booster cylinder.

In that configuration, the pressure oil is confined within the A-hydraulic circuit forming a high-pressure state; when the pilot check valve is closed, a high-pressure state such that the pressure oil of high-pressure is confined within the B-hydraulic circuit is formed; the controlling driver device produces a piston movement amount signal on the driver on the basis of a generated control-driving signal to cause the piston to make a controlled move and performs pressure control of the high-pressure oil in a high-pressure state to apply the pressure controlled roll force or pressing force on the corresponding ram; thereby the roll force or the pressing force is given between the upper and lower rolls; and the material to be rolled is rolled or pressed.

The present invention provides a hydraulic screw-down device of a rolling mill or of a roll press machine.

The invention is characterized in that, in a screw-down device of a rolling mill that rolls a steel plate as a material to be rolled with a roll, or of a roll press machine that presses a material with a roll, the rolling or the pressing is performed by giving roll force or pressing force between the upper and the lower rolls by moving vertically the ram of a screw-down cylinder incorporated in the housing of the rolling mill or the roll press machine by the pressure oil from a hydraulic pump.

The hydraulic screw-down device is comprised of a booster cylinder;

a piston incorporated in the booster cylinder;

a rod, which has thread grooves on the surface, connected with the piston;

a screw-engaging device that engages the thread grooves;

a controlling driver device comprising a driver main body for driving the rod and a controlling driver motor, which is connected with the driver main body, for controlling the range of movement of the piston;

an A-hydraulic circuit, which has a pilot check valve, for moving the ram vertically by the pressure oil; and a B-hydraulic circuit, which is connected with the A-hydraulic circuit, for connecting the screw-down cylinder and the booster cylinder.

In that configuration, the pressure oil is confined within the A-hydraulic circuit forming a high-pressure state;

when the pilot check valve is closed, a high-pressure state such that the pressure oil of high-pressure is confined within the B-hydraulic circuit is formed;

the controlling driver device produces a piston movement amount signal on the basis of a generated control-driving signal, wherein the piston movement is caused by engaging the screw-engaging device and the thread grooves to cause the piston to make a controlled move, and performs pressure control of the high-pressure oil in a high-pressure state to apply the pressure controlled roll force or pressing force on the corresponding ram;

thereby the roll force or the pressing force is given between the upper and the lower rolls; and the material to be rolled is rolled or pressed.

The present invention provides a hydraulic screw-down device of a rolling mill or of a roll press machine stated above, wherein the driver provided in the controlling driving device in the hydraulic screw-down device of the rolling mill or the roll press machine stated above rotates the rod to control the rotational angle freely.

The present invention provides a hydraulic screw-down device of the rolling mill or of the roll press machine stated above, wherein an accumulator is connected to an oil chamber located at the position opposite to an oil chamber on the rod side of the booster cylinder and the accumulator pressure of the accumulator is applied on the piston.

The present invention provides a rolling mill or a roll press machine that has the hydraulic screw-down device stated above, wherein, where the screw-down screw of an electric screw-down apparatus is provided on the top of the housing of the rolling mill or the roll press machine, the screw-down cylinder is installed in the cylindrical recess after the removal of the screw-down screw of the electric screw-down apparatus and is fabricated so that the ram arranged inside the screw-down cylinder can move vertically, the booster cylinder is disposed on the top face of the housing of the rolling mill, and the screw-down cylinder and the booster cylinder are connected via the A-hydraulic circuit and the B-hydraulic circuit, above the rolling mill housing.

The present invention provides the hydraulic screw-down device of the rolling mill or of the roll press machine stated above, wherein the controlling driver device rotates the rod by the engagement of the screw-engaging device with the thread groove to control the rotational angle freely.

The present invention provides a method of hydraulic control using the hydraulic screw-down device of a rolling mill or of a roll press machine.

The hydraulic screw-down device in the provided method is such a device that is used in a rolling mill that rolls a steel plate as a material to be rolled with a roll, or in a roll press machine that presses a material with a roll, wherein the rolling or the pressing is performed by giving roll force or pressing force between the upper and the lower rolls by moving vertically the ram of a screw-down cylinder incorporated in the housing of the rolling mill or the roll press machine by the pressure oil from a hydraulic pump.

The hydraulic screw-down device is comprised of a booster cylinder;

a piston incorporated in the booster cylinder;

a rod connected with the piston;

a controlling driver device comprising a driver for driving the rod and a controlling driver motor, which is connected with the driver, for controlling the range of movement of the piston;

an A-hydraulic circuit, which has a pilot check valve, for moving the ram vertically by the pressure oil; and a B-hydraulic circuit, which is connected with the A-hydraulic circuit, for connecting the screw-down cylinder and the booster cylinder.

In that method, the rolling mill or the roll press machine rolls or presses the steel plate as a work piece through the workings comprising:

forming a high-pressure state by confining the pressure oil within the A-hydraulic circuit;

closing the pilot check valve;

forming a high-pressure state such that the pressure oil of high-pressure is confined within the B-hydraulic circuit;

producing the piston movement amount signal for the driver on the basis of the controlling driving signal generated according to the position signal of the upper and the lower rolls to cause the piston to make a controlled move;

controlling the pressure of the high-pressure oil in a high-pressure state;

applying the pressure controlled roll force or pressing force to the corresponding ram;

giving thereby the roll force or the pressing force between the upper and the lower rolls; and rolling or pressing the material to be rolled.

The present invention provides a method of hydraulic control using a hydraulic screw-down device of a rolling mill or of a roll press machine.

The hydraulic screw-down device in the provided method is such a device that is used in a rolling mill that rolls a steel plate as a material to be rolled with a roll, or in a roll press machine that presses a material with a roll, wherein the rolling or the pressing is performed by giving roll force or pressing force between the upper and the lower rolls by moving vertically the ram of a screw-down cylinder incorporated in the housing of the rolling mill or the roll press machine by the pressure oil from a hydraulic pump.

The hydraulic screw-down device is comprised of a booster cylinder;

a piston incorporated in the booster cylinder;

a rod, which has thread groove on the surface, connected with the piston;

a screw-engaging device that engages the thread groove;

a controlling driver device comprising a driver for driving the rod, and a controlling driver motor, which is connected with the driver, for controlling the range of movement of the piston;

an A-hydraulic circuit, which has a pilot check valve, for moving the ram vertically by the pressure oil; and a B-hydraulic circuit, which is connected with the A-hydraulic circuit, for connecting the screw-down cylinder and the booster cylinder.

In that method, the rolling mill or the roll press machine rolls or presses the steel plate as a work piece through the workings comprising:

forming a high-pressure state by confining the pressure oil within the A-hydraulic circuit;

closing the pilot check valve;

forming a high-pressure state such that the pressure oil of high-pressure is confined within the B-hydraulic circuit;

producing the piston movement amount signal for the movement of the engagement of the screw-engaging device and the thread groove on the basis of the controlling driving signal generated according to the position signal of the upper and the lower rolls to cause the piston to make a controlled move;

controlling the pressure of the high-pressure oil in a high-pressure state;

applying the pressure controlled roll force or pressing force to the corresponding ram;

giving thereby the roll force or the pressing force between the upper and lower rolls; and rolling or pressing the material to be rolled.

Advantageous Effects of Invention

The present invention provides a hydraulic screw-down device that is able to obtain the required roll force between mill rolls in a small-seize rolling mill or a roll press machine by controlling accurately the position of the ram in a hydraulic cylinder using an electric servo motor without using a hydraulic servo control valve that is used in a large-size rolling mill.

Further, the present invention is capable of providing a rolling mill having a hydraulic screw-down device that allows a short time replacement operation at a low cost by removing a worm-gear reducer or male screws or female screws for a screw-down mechanism incorporated in an existing small-size rolling mill as a screw-down apparatus.

MODES FOR IMPLEMENTING INVENTION

Figure 2:
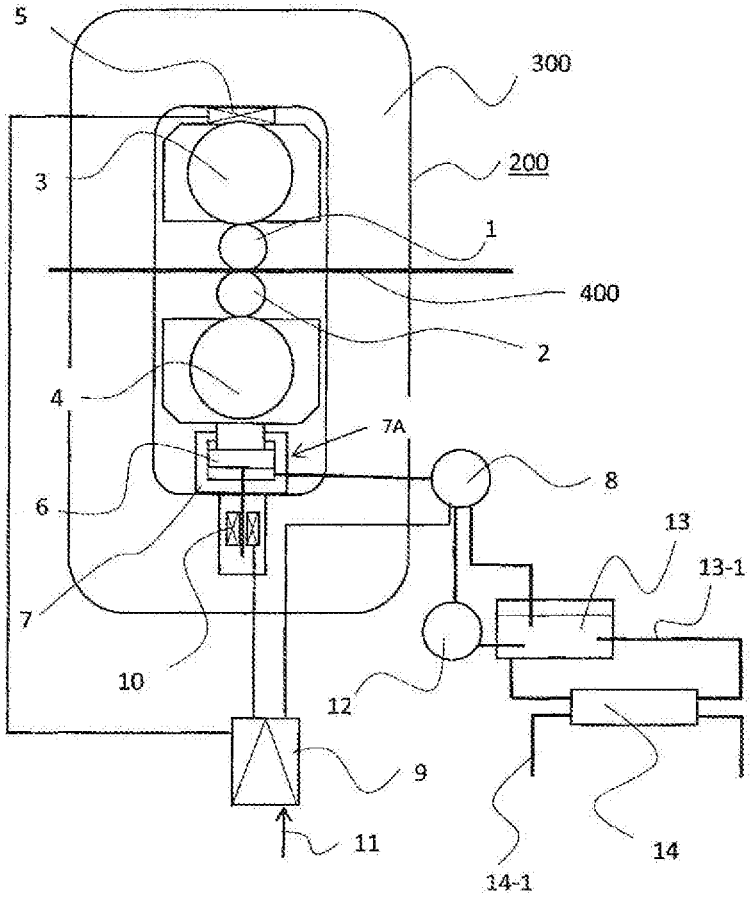
FIG. 2 This is a schematic diagram of the configuration of a rolling mill equipped with a screw-down apparatus using a hydraulic servo control valve used widely in conventional arts.

A hydraulic screw-down apparatus incorporated in a typical four high rolling mill used in ironworks is explained referring to FIG. 2.

The rolling mill has an upper and a lower work rolls 1 and 2, which are pressed from the outside by an upper and a lower backup rolls 3 and 4; a metal plate 400, as a material to be rolled, is rolled between the work rolls 1 and 2, wherein a housing 300 bears the roll force. In the subordinate position of the lower backup roll 4, a screw-down cylinder 7A for pressing the mill roll, the screw-down cylinder 7A comprising a cylinder 7 and a screw-down ram 6 held in the cylinder 7; a hydraulic servo valve 8 that controls the oil pressure in the cylinder 7; and a control panel 9 that drives the hydraulic servo valve 8 are provided. For example in this configuration, the hydraulic servo control valve 8 is controlled by control signals received, adding thereto a signal 11 from a superordinate control apparatus. The control signal so received is a signal sent from a position sensor 10 that feeds back the detection signal obtained by sensing the position of a ram 6 as a screw-down ram to the control panel 9, and likewise the control signal so received is a signal sent from such as a load cell 5 that feeds back the measurements of the pressing force of the mill roll to the control panel 9.

A pressure oil of high-pressure is pressurized by a hydraulic pump 12 and is fed to the hydraulic servo control valve 8. When continuously using oil pressurized to high-pressure in the hydraulic servo control valve 8, pressure energy changes into heat energy causing temperature rise in the oil in the tank. For stable control of the mill roll position, the oil is sent to a chilling cooler 14 as a cooling equipment from an oil tank 13 as a hydraulic tank via a piping 13-1 so that the oil temperature will not rise beyond certain degree.

The chilling cooler 14 cools the oil in the oil tank 13 to the purpose temperature using cooling water fed via the piping 14-1.

When the hydraulic servo control vale 8, which is used in large-size rolling mills, is used for position control of the mill roll in the small-size rolling mills, use of the same pressure as used in large-size rolling mills is needed to maintain the roll force between the work rolls 1 and 2. If the pressure is low, the positioning accuracy of the mill roll is degraded.

Small amount of oil is enough for small-size rolling mills. However, to gain the same oil pressure as in large-seize roll mills, a high-pressure hydraulic pump 12 and a dedicated oil tank 13 are needed; further the chilling cooler 14 and plenty of water are required for suppression of the temperature rise of the oil in the oil tank 13.

Usually, many factories among users of small-size rolling mills do not have facilities capable of supplying enough cooling water. To maintain hydraulic pressure always at high-pressure, a frequent operation of the hydraulic pump 12 is needed; this consumes a lot of electricity and would leave the situation increasingly far from the energy saving factory sought from now. For this reason, many small-size rolling mills have conventionally employed a mechanical roll positioning apparatus having a male screw and a female screw for a screw-down mechanism. However, the positioning accuracy of the mill roll in a mechanical rolling roll positioning mechanism is lower as compared to the hydraulic screw-down device for reasons such as backlash of the gears used in the mechanism. If the period of use of the rolling mill becomes longer, the mechanical interstice such as backlash increases further.

In recent years, the thickness accuracy of the finished rolled material is required to be high even in a small-size rolling mill and a high-performance hydraulic screw-down device suitable for energy saving operation has been demanded.

Figure 1:
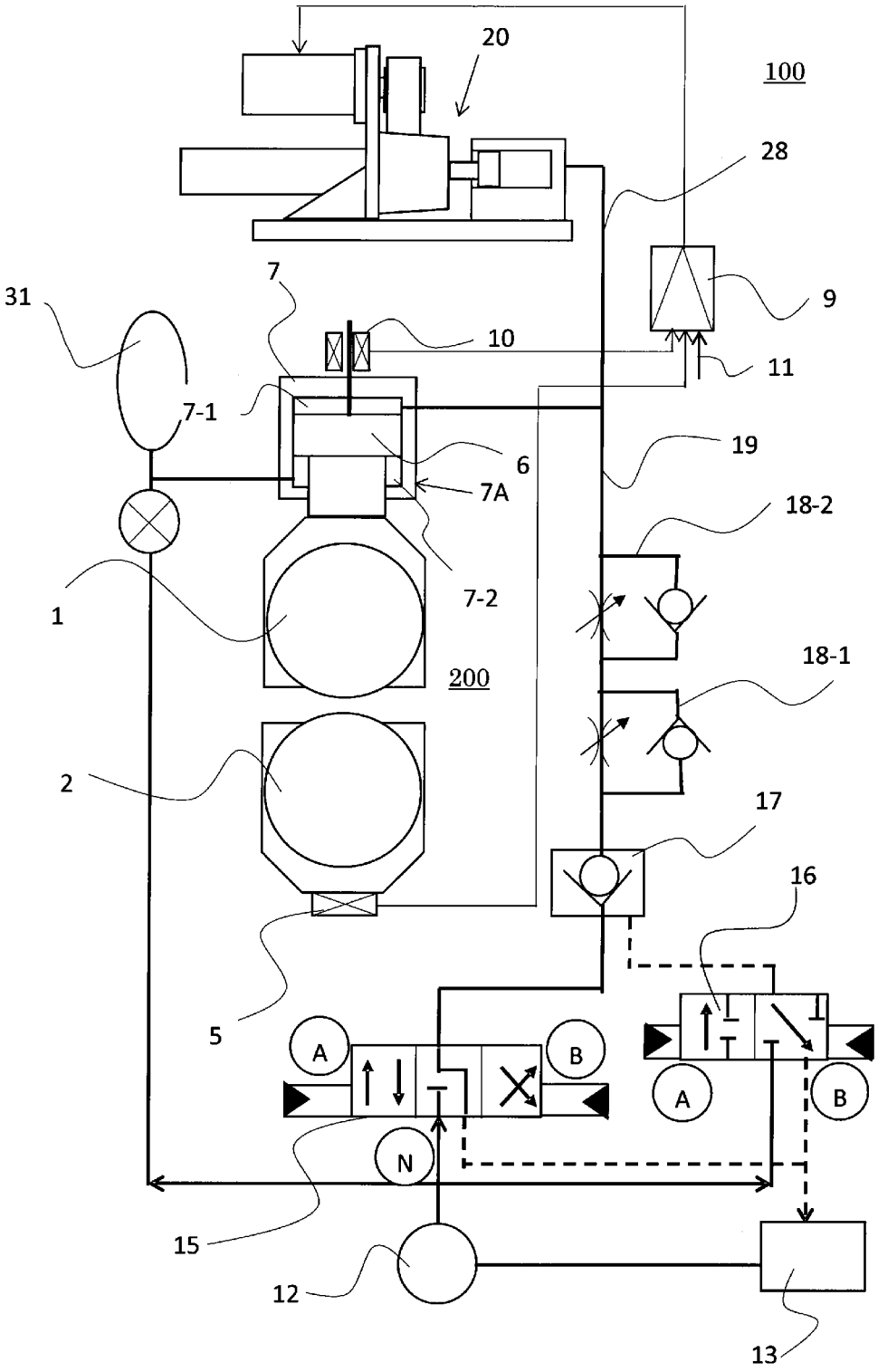
FIG. 1 This is a schematic diagram of the configuration of a rolling mill equipped with a screw-down device having a booster cylinder of an embodiment of the present invention.

The configuration of a hydraulic screw-down device 100 that solves these problems and is suitable for a small-size rolling mill and for a roll press machine 200 is explained referring to FIG. 1. Description takes a small-size rolling mill as an example and refers to it as the small-size rolling mill 200.

The explanatory example is a 2-high rolling mill having two working rolls: the upper work roll 1 and the lower work roll 2. The small-size rolling mill 200 mostly employs this style. The screw-down cylinder 7A for pressing the upper work roll 1 is arranged on the upper work roll 1. The screw-down cylinder 7A is comprised of the cylinder 7, the ram 6 that vertically moves, and the position sensor 10 that accurately measures the position of the ram 6.

The metal plate 400, which is a material to be rolled but is not shown, is inserted between the upper work roll 1 and the lower work roll 2. The roll force of these work rolls can be measured by the load cell 5 disposed between the housing 200 and a bearing box that retains the lower work roll 2. The hydraulic pump 12 and the oil tank 13 are provided and the pressurized pressure oil fed from the hydraulic pump 12 is sent to the cylinder 7. A solenoid valve 15 that controls the vertical movement of the ram 6 in the cylinder 7 is disposed at the intermediate position on the piping between the hydraulic pump 12 and the cylinder 7. In addition, in the middle of this piping, a pilot check valve 17 that prevents the oil from returning to the oil tank 13 from a rod side oil chamber 7-1 of the cylinder 7 even when the hydraulic pump 12 is not in operation, the solenoid valve 16 for passing oil to open or close the pilot check valve 17 forcibly, and restrictor valves 18-1 and 18-2 for regulating the flow amount to the cylinder 7 are disposed. This hydraulic circuit is denoted as an A-hydraulic circuit 19. An accumulator 31 is provided for applying a certain degree of pressure on a counter-rod side oil chamber 7-2 of the cylinder 7 in order to prevent the ram 6 from moving down due to its own weight when occurring no roll force.

A booster cylinder 20 that is able to control precisely the position of the ram 6 is installed at a place close to the screw-down cylinder 7A; a hydraulic circuit that connects directly the cylinder 7 with the booster cylinder 20 is defined as a B-hydraulic circuit 28. The A-hydraulic circuit 19 and the B-hydraulic circuit 28 are connected in a T-shape allowing the pressure oil in the booster cylinder 20 to flow to the screw-down cylinder 7A.

Figure 3:
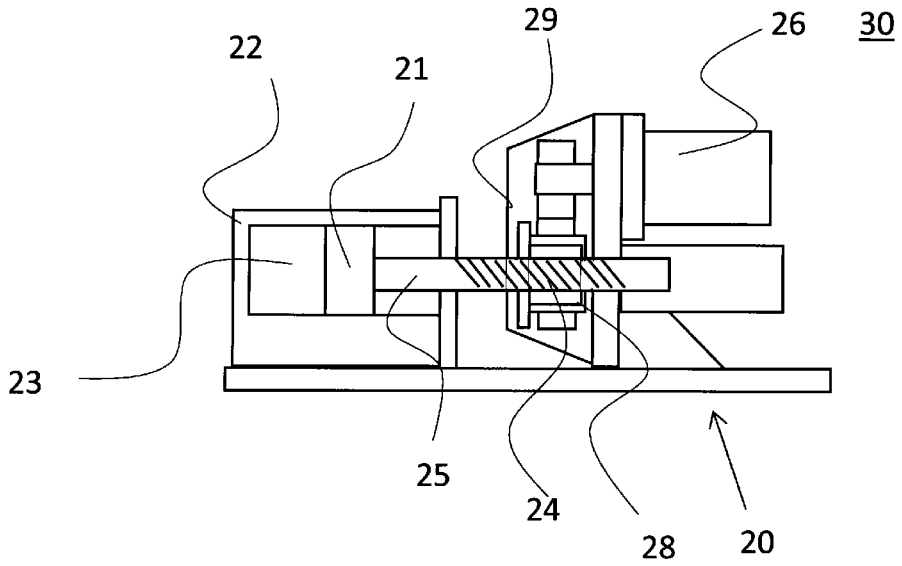
FIG. 3 This is a side view to explain the working of a booster cylinder incorporated in the hydraulic screw-down device shown in FIG. 1.

The construction of the booster cylinder 20 is as shown in FIG. 3. The booster cylinder device 20 is comprised of a cylinder 22 for pressurizing oil, a piston 21 that reciprocates in the cylinder 22, an oil chamber 23 that is pressurized by the piston 21, and a screw 24 that reciprocally moves a rod 25 connected with the piston 21. The screw 24 has a function to translate the angle of the rotation of a control motor 26 to a reciprocal movement.

In the booster cylinder device 20 configured as stated above, the control motor 26 rotates by commanded angle on the basis of the signal from the control panel 9 shown in FIG. 1, and the amount of the rotational angle is converted into an amount of the longitudinal movement of the rod 25 by the screw 24 via a transmission section. The piston 21, which is integral with the rod 25, moves in the cylinder 21 so as to pump the oil in the oil chamber 23 to the rod side oil chamber 7-1 of the screw-down cylinder 7A by the exact amount of the purpose quantity, or the piston 21 has a function to receive the oil in the rod side oil chamber 7-1 into the oil chamber 23.

The control panel 9 controls the rotation of the control motor 26 using the signals: the signal 11 from the outside, the signal from the position sensor 10 mounted on the screw-down cylinder 7A, and the signal from the load cell 5.

As shown in FIG. 3, the hydraulic screw-down device 100 of the small-size rolling mill 200, in concrete, comprises a booster cylinder 22, the piston 21 incorporated in the booster cylinder 22, and the rod 25 connected with the piston 21, wherein the rod 25 has the thread grooves of the screw 24 on the surface. The screw 24 has a screw-engaging device 31 that engages with the thread groove. A controlling driver device 30 comprises the screw 24, a driver 29 that drives the rod 25, and a control motor 26 that is connected with a driver 29 and controls the range of the piston movement.

A controlling driver device 30 rotates the rod 25 using the engagement of the screw-engaging device with the thread groove established by the screw-engaging device 31 and the screw 24 of the driver 29, and controls freely the rotational angle.

As shown in FIG. 1, the hydraulic screw-down device 100 comprises the A-hydraulic circuit 19 that has the pilot check valve 17 and moves the ram 6 vertically by the pressure oil, and the B-hydraulic circuit 28 that is connected with the A-hydraulic circuit 19 and connects the screw-down cylinder 7A and the booster cylinder 22.

The pressure oil is confined within the A-hydraulic circuit 19 and a high-pressure state is formed. When the pilot check valve 17 is closed, a high-pressure state is formed, in which state the high-pressure oil is confined within the B-hydraulic circuit 28. A controlling driver means 30 produces the movement amount signal of the piston 21 for the movement of the piston 21 by the engagement of the screw-engaging device 31 and the thread grooves of the screw 24, on the basis of the controlling driving signal generated according to the position signal of the upper and the lower rolls 1 and 2, to cause the piston 21 to make a controlled move; controls the pressure of the high-pressure oil in a high-pressure state; applies the pressure controlled roll force on the ram 6; and gives thereby the roll force between the upper and the lower rolls 1 and 2 to roll the metal plate 400 of a material to be rolled.

Figure 7:
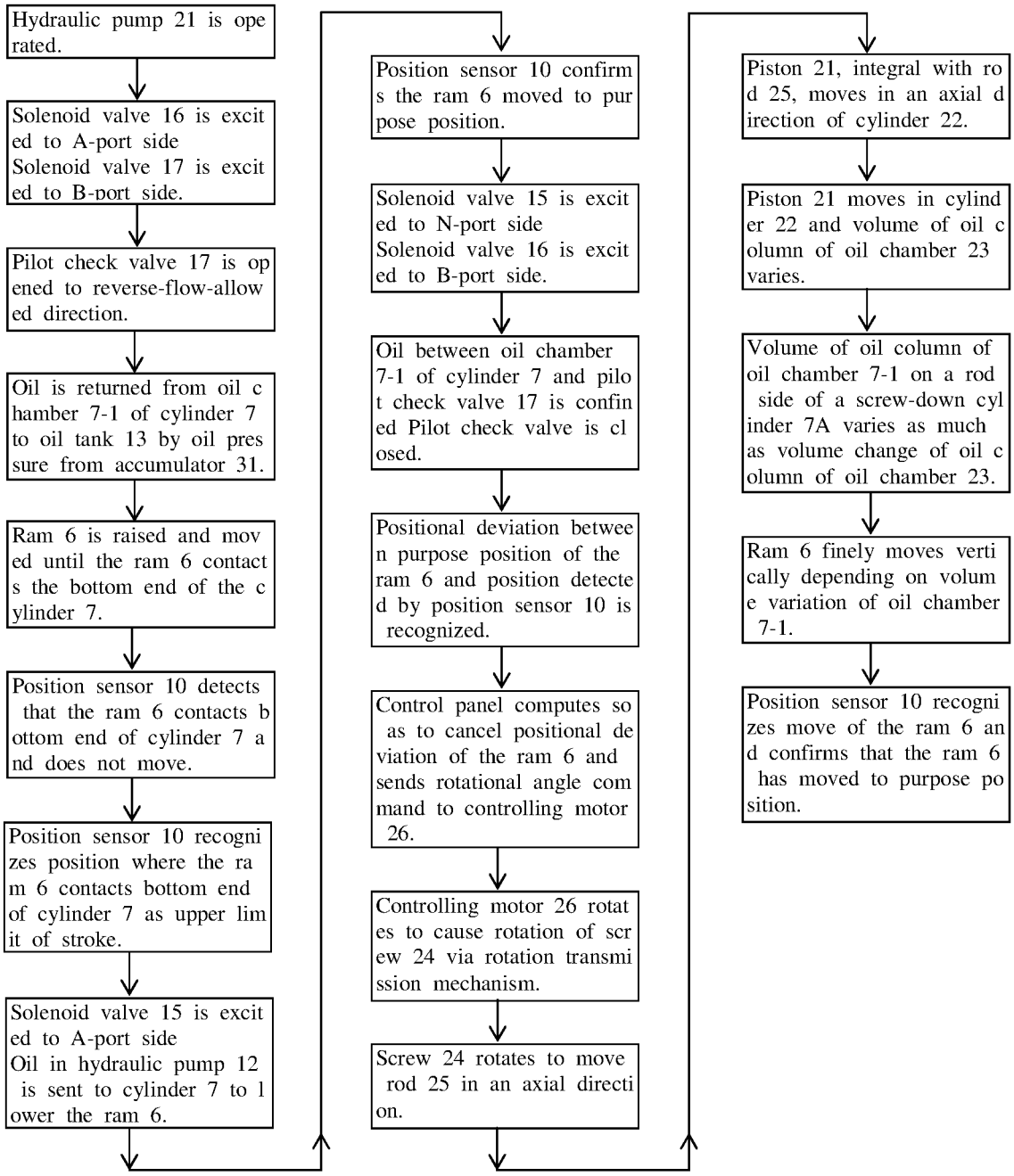
FIG. 7 This is an example of flowchart of the working of the hydraulic screw-down device shown in FIG. 1.

Working of the hydraulic screw-down device that uses the booster cylinder device 20 is described below referring to FIG. 2 and the flowchart in FIG. 7. The sequence of working is comprised of steps S1 to S20 as shown in the figure.

At first, a solenoid valve 16 is excited to the A-port side and further the solenoid valve 15 is excited to the B-port side. Then, the pilot check valve 17 is opened to the reverse-flow-allowed direction and the oil is returned from the oil chamber 7-1 to the oil tank 13 by the hydraulic pressure given by an accumulator 31 that always applies a certain degree of pressure on the counter-rod side oil chamber 7-2 in the cylinder 7 to cause the ram 6 to rise. The ram 6 stops moving when the ram reaches the bottom end of the cylinder 7. The stop of the ram 6 movement is detected by the position sensor 10 and that stop position is memorized as the upper limit of the stroke of the ram 6.

The solenoid valve 15 is excited to the A-port side, and the ram 6 is lowered to the position of the upper working roll 1 which is appropriate for the rolling thickness of the metal plate 400. The position sensor 10 confirms that the ram 6 moved to the purpose position. Then, the solenoid valve 15 is moved to the N-port and the solenoid valve 16 is switched to the B-port. Thereafter, the pilot check valve 17 is closed so that the oil cannot flow reversely to the oil tank 13 from the oil chamber 7-1 of the cylinder 7. Thus, the oil existing between the oil chamber 7-1 of the cylinder 7 and the pilot check valve 17 is confined.

As another method, where the metal plate 400 is thin, the solenoid valve 15 is excited to the A-port side to lower the ram 6 by feeding the pressurized pressure oil from the hydraulic pump 12 to the cylinder 7 so that the upper work roll 1 will contact the lower work roll 2. The load cell 5 measures the contact force, i.e., the roll force, between the upper and the lower work rolls. When the load cell 5 indicates a certain value of roll force, the position of the ram 6 is measured with the position sensor 10 and memorized.

The solenoid valve 16 is excited to the A-port side and further the solenoid valve 17 is excited to the B-port side. Then, the pilot check valve 17 is opened to the reverse-flow-allowed direction, the oil is returned from the oil chamber 7-1 to the oil tank 13, and the ram 6 is raised to the position of the upper working roll 1 that is appropriate for the rolling thickness of the metal plate 400. The amount of movement of the ram 6 is defined based on the roll position where the load cell 5 recognizes a certain degree of contact force between the upper and the lower work rolls 1 and 2. The ram 6 is raised according to the amount of movement measured by the position sensor 10. At this time of movement, the ram 6 is moved by a low hydraulic pressure of 700 $N/cm^2$ or less because the state is no-load; the restrictor valves 18-1 and 18-2 control the flow rate of the oil from the hydraulic pump 12 to the cylinder 7 so that the vertical moving speed of the ram 6 will be as desired.

The position sensor 10 confirms that the ram 6 moved to the purpose position. Then, the solenoid valve 15 is moved to the N-port and the solenoid valve 16 is switched to the B-port. Thereafter, the pilot check valve 17 is closed so that the oil cannot flow reversely to the oil tank 13 from the oil chamber 7-1 of the cylinder 7.

The position control by the screw-down cylinder 7A using the solenoid valve 15 allows a smooth vertical movement of the ram 6; however, the stop position of the ram 6 cannot be controlled finely in microns. Therefore, the quantity of the oil confined within the oil chamber 7-1 of the cylinder 7 is increased and decreased with the pilot check valve 17 using the booster cylinder 20 to enable the ram 6 to move vertically in microns for an accurate position control.

As stated previously, the booster cylinder 20 is controlled in a manner described below. The control Panel 9 transmits to the control motor 26 the rotational angle that the control motor 26 has to rotate. The control motor 26 rotates specified number of rotation or angle to turn the screw 24. The control motor 26 employs an AC servomotor, which can rotate forward-and-reverse at high-speed. The screw 24 usually employs a ball-screw to eliminate to a limitless extent the interstice such as backlash; the ball screw translates the rotational force of the screw 24 to the axial direction thrust motion of the rod 25. Since the rod 25 and the piston 21 are integral, a minute movement of the piston 21 toward pushing side compresses the oil chamber 23 by the cylinder 22 and the piston 21 causing the oil pressure rise inside the booster cylinder device 20. Then, the oil pressure in the oil chamber 23 becomes higher than the pressure in the oil chamber 7-1 of the screw-down cylinder 7A, and consequently a minute amount of oil volume produced by the movement of the piston 21 is fed from the oil chamber 23 to the oil chamber 7-1 in the screw-down cylinder 7A. The oil so fed pressurizes the ram 6 of the screw-down cylinder 7A and pushes down the ram 6 at the same time. When the ram 6 is pushed down, the position sensor 10 connected with the ram 6 detects and measures the positional variation of the ram 6 and sends the measurement to the control panel 9. When the ram 6 is to be pushed up, they work in reverse order.

As described above, the controlling driver device is comprised of the booster cylinder device20, the piston 21 incorporated in the booster cylinder device 20, the drive that drives the rod 25, and the controlling driving motor 26 that is connected with the driver and controls the movement range of the piston. The controlling driver device produces the movement amount signal of the piston 21 for the driver on the basis of a generated control-driving signal, wherein the piston movement is caused by engaging the screw-engaging device and the thread grooves, to cause the piston 21 to make a controlled move, and performs pressure control of the high-pressure oil in a high-pressure state to apply the pressure controlled roll force or pressing force on the ram 6; thereby the roll force or the pressing force is given between the upper and lower rolls; and the material to be rolled is rolled or pressed.

The controlling driver device in an embodiment is comprised of the booster cylinder 20; the piston 21 incorporated in the booster cylinder; the rod 25, which is connected with the piston 21, having thread grooves on the surface; the screw-engaging device that engages the thread grooves; the driver that drives the rod 25; and the controlling driving motor 26, which is connected with the driver, for controlling the piston movement range.

The controlling driver device produces the movement amount signal of the piston 21 on the basis of a generated control-driving signal, wherein the piston movement is caused by engaging the screw-engaging device and the thread grooves, to cause the piston 21 to make a controlled move; and performs pressure control of the high-pressure oil in a high-pressure state to apply the pressure controlled roll force or pressing force on the ram 6; thereby the roll force or the pressing force is given between the upper and the lower rolls; and the material to be rolled is rolled or pressed.

When the metal plate 400 is undergoing rolling between the upper and the lower work rolls 1 and 2, the thickness after the rolling is measured with a thickness-measuring device, which is not illustrated, to examine the deviation from the target thickness of the metal plate 400. Then, the hydraulic screw-down control is performed in a manner such that the control panel 9 transmits the control signal 11 to cause the control motor 26 to rotate appropriate rotational angle suitable for the amount of vertical movement of the ram 6 to cancel the thickness deviation.

For controlling the thickness accuracy of the metal plate 400 in microns, when, for example, the roll force of 100 tons is to be generated by two screw-down cylinders 7A, the use of the screw-down cylinder 7A having a ram of 180 mm in diameter requires generating an oil pressure of 2000 N/cm$^2$ in the oil chamber 7-1. This means that to raise the ram 6 by 1 μm with 100 tons of force needs to increase the amount of oil in the oil chamber 7-1 by 25.4 mm$^3$ of high-pressure oil of 2000 N/cm$^2$.

When the diameter of the cylinder 22 of the booster cylinder device 20 is 20 mm, it is necessary to push the piston 21 by 0.081 mm in order to pressurize the oil chamber 23 of the cylinder 22 to a pressure of 2000 N/cm$^2$ to cram 25.4 mm$^3$ of oil into the cylinder 7. To pressurize the oil chamber 23 of the cylinder 22 to a pressure of 2000 N/cm$^2$ needs a force of 6.28 kN to push the piston.

If the piston 21 is pushed by the force of 6.28 kN, the hydraulic pressures of the oil chamber 7-1 of the screw-down cylinder 7A and the oil chamber 23 of the cylinder 22 will be balanced at a hydraulic pressure of 2000 N/cm$^2$. The press-down force of the screw-down cylinder 7A becomes a roll force of 508.7 kN; this means that use of the area ratio of the cylinder 7 and the cylinder 22 makes it possible to achieve a pressure boost ratio of 81 times compared to 6.28 kN of the pressure of the piston 21. When the piston 21 is moved by 0.081 mm under the condition that the pressure between the cylinder 7 and the cylinder 22 are balanced, the screw 24 should be rotated by 4.86° when the lead of the screw 24 is 6 mm The control motor 26 controls the rotational angle easily, and feeds the 25.4 mm$^3$ of oil from the oil chamber 23 of the cylinder 22 to the oil chamber 7-1 to lower the ram 6 accurately by one micrometer.

Using the booster cylinder device 20 provides a larger boosting property compared to the conventional mechanical mill roll positioning mechanism. Further, use of a screw gives a high efficiency to the power-transfer, which allows an accurate positioning of the mill roll with a small motor.

Furthermore, unlike the hydraulic screw-down device using the hydraulic servo control valve 8, it is not necessary to generate a high hydraulic pressure always. Because of this, the oil temperature does not rise; therefore, the cooling system is not needed and providing newly the cooling water supply system is not necessary. Although the hydraulic servo control valve 8 is not illustrated, the accurate control of the oil amount requires flowing a high-pressure oil between the narrow gap in the hydraulic servo control valve 8. At that time, if a fine foreign matter is mixed in the oil, the foreign object enters the narrow gap, there is a possibility of inhibiting the smooth flow of oil. Therefore, the oil used in the hydraulic screw-down system should have highly controlled cleanliness property and it is necessary to consider installing a fine mesh filters at several places so that foreign matters are not immixed in the oil.

Figure 4:
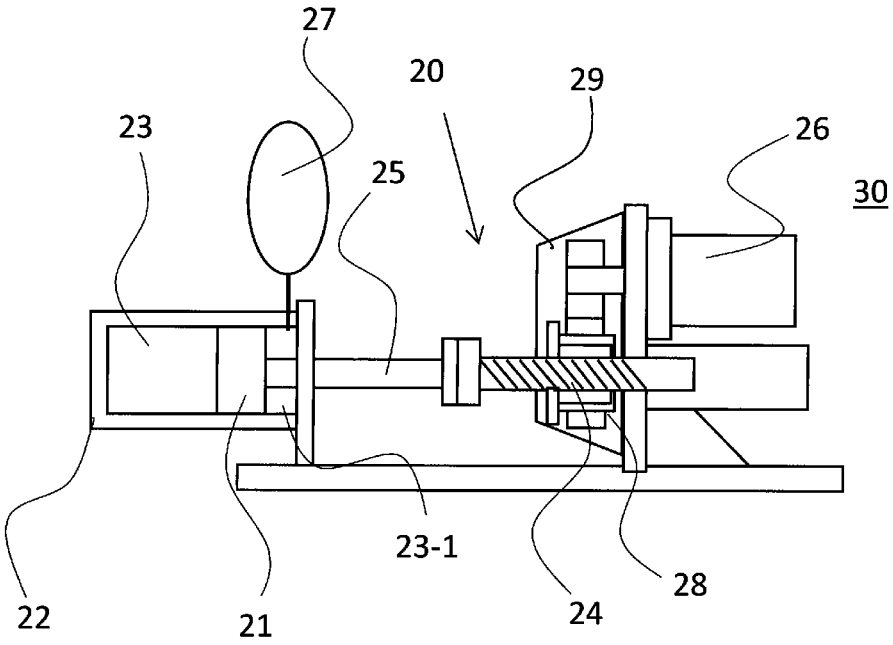
FIG. 4 This is a side view to explain the working of a booster cylinder incorporated in the hydraulic screw-down device shown in FIG. 1.

The weak point of the booster cylinder 20 using a screw compared to the hydraulic screw-down apparatus using the hydraulic servo control valve 8 is that the piston 21 has to be pushed with large force in order to make the oil pressure of the oil chamber 23 high. A means for overcoming this problem is described below referring to FIG. 4.

If pushing the rod 25 only by the thrust of the screw 24 by the control motor 26 is not able to complete the pushing stroke, a hydraulic pressure is added to a counter-oil chamber side 23-1. Thereby, pushing force of the sum of the pushing force generated by the screw 24 and the hydraulic pressure applied on the counter-oil chamber side 23-1 occurs in the oil chamber (the head side) 23. It is possible to generate a pushing force to gain the pushing force of the rod side 23-1 by using the hydraulic pressure of the accumulator 27 without using the hydraulic pressure of the hydraulic pump 12. On the contrary, it is necessary to overcome the pushing force of the accumulator 27 when returning the rod 25 to the rod side 23-1. Addition of a hydraulic pressure to the rod side 23-1 can level the force for pushing and pulling the piston 21 and reduces the maximum output of the control motor 26 required of the movement of the piston 21 allowing use of a smaller size of the control motor 26.

When the diameter of the cylinder 22 of the booster cylinder 20 is 40 mm for example, the piston 21 has to be pushed at a force of 25.1 kN to boost the pressure of the oil chamber 23 of the cylinder 7 of 40 mm diameter to 2000 N/cm$^2$. If the accumulator 27 supplies a hydraulic pressure of 1500 N/cm$^2$ to the counter-oil chamber side 23-1, a force of 11.5 kN that pushes the piston 21 is added where the diameter of the rod 25 is 25 mm The pushing force by the thrust of the screw 24 required for boosting the pressure to 2000 N/cm$^2$ can be reduced down to 13.6 kN. In contrast, however, when the piston 21 is to be moved to the counter-oil chamber side 23-1 while the pressure of the oil chamber 23 of the cylinder 7 is 0 N/cm$^2$, the returning force of 11.5 kN has to be transferred from the screw 24 to the rod 25 to overcome the pressure of the accumulator 27.

In an elevator, a counterweight is installed on the opposite side of the car of the elevator to reduce the lifting load difference due to the weight difference of passengers in the car and thereby to reduce the maximum power requirement of a drive motor that generates a lifting force. The pressure of the accumulator 27 works similarly to a counterweight of elevators. In the booster cylinder 20, providing the accumulator 27 reduces the difference of pushing and pulling forces and makes it possible to level the torque requirements for the control motor 26 for rotating the screw 24.

Figure 6:
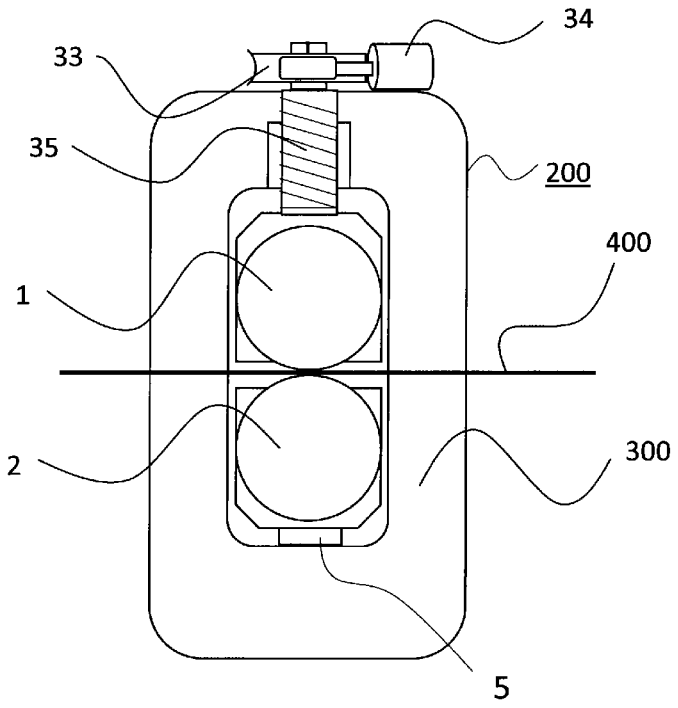
FIG. 6 This is an illustration to show an example of existing rolling mills, which has a mechanical screw-down apparatus.

Many small-size rolling mills have the mechanical screw-down apparatus as shown in FIG. 6. However, the mechanical screw-down apparatus has become not possible to satisfy the recent requirement, because, in late years, the metal plate 400, which is a material to be rolled, has become thinner and the thickness of finished products by rolling or pressing has been required to have an accuracy of microns. Using the hydraulic screw-down device 100 stated above allows responding to such severe plate thickness requirement. It is however desirable that the conventional mechanical screw-down apparatus is replaced with the hydraulic screw-down device 100, with a minimized impact on the equipment operating time.

Means capable of solving these problems easily is described below referring to FIG. 5 and FIG. 6. A worm reducer 33 mounted on a housing 300, a screw-down screw 35 that is rotated by the worm reducer 33, and a driving motor 34 that rotates the worm reducer 33 are removed from the housing 300. After the removal, the screw-down cylinder 7A is inserted using a round recess in which the screw-down screw 35 on the upper work roll 1 was incorporated. Using the recess, in which the screw-down screw 35 was incorporated, does not require providing a space newly for disposing the screw-down cylinder 7A on the housing 300.

Figure 5:
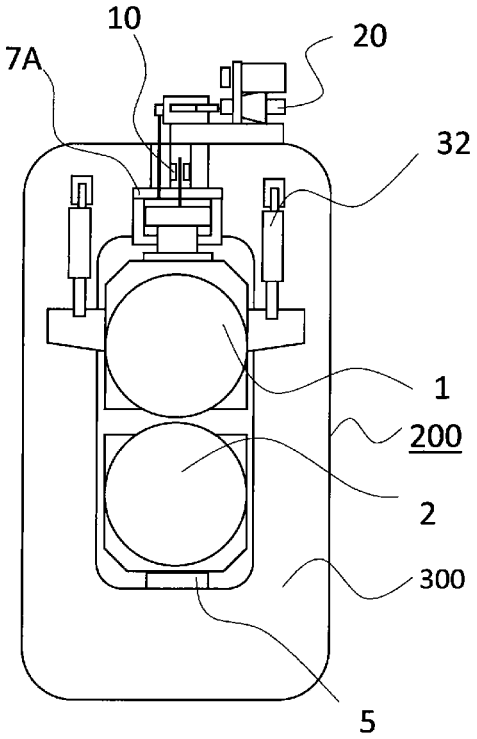
FIG. 5 This is an illustration to show an example of configurations in an embodiment of the present invention, in which a hydraulic screw-down device is equipped on a rolling mill.

Further, disposing the booster cylinder device 20 and the solenoid valve 15 on the housing 300, where the worm reducer 33 and the driving motor 34 are mounted, permits them to be connected at a close location with the screw-down cylinder 7A as shown in FIG. 5.

When it is intended to dispose the screw-down cylinder 7A above the upper work roll 1 with less modification of the existing housing 300 as much as possible, situation sometimes will not allow mounting the counter-rod oil chamber 7-2 in the cylinder 7. To keep the ram 6 always pushed up, a balance cylinder 32 that lifts the upper work roll 1 is used as shown in FIG. 6. When a bearing box 1-1 that supports the upper work roll 1 is lifted with the balance cylinder 32, the ram 6 of the screw-down cylinder 7A is pushed up and the pressure of the rod side oil chamber 7-1 can be increased.

A method of hydraulic pressure control using the hydraulic screw-down device of a small-size rolling mill or of a roll press machine is provided.

The small-size rolling mill or the roll press machine in this method rolls the work piece to be rolled through the workings comprising:

forming a high-pressure state by confining the pressure oil within the A-hydraulic circuit;

closing the pilot check valve;

forming a high-pressure state such that the pressure oil of high-pressure is confined within the B-hydraulic circuit;

producing the piston movement amount signal for the piston movement that is cause by the driver or the engagement of the screw-engaging device and the thread groove on the basis of the controlling driving signal generated according to the position signal of the upper and the lower rolls to cause the piston to make a controlled move;

controlling the pressure of the high-pressure oil in a high-pressure state;

applying the pressure controlled roll force or pressing force to the corresponding ram;

giving thereby the roll force between the upper and the lower rolls; and rolling or pressing the material to be rolled.

As stated above, the present invention is capable of providing a work method that can change in a short time from an existing small-size rolling mill having a mechanical mill roll positioning mechanism that uses a male and a female screw for screw-down to an existing small-size rolling mill having the hydraulic screw-down mechanism that is able to hydraulically control the thickness of the material to be rolled.

REFERENCE SIGNS LIST

1 Upper work roll
2 Lower work roll
5 Load cell
6 Ram
7 Cylinder
7A Screw-down cylinder
8 Hydraulic servo control valve
9 Control panel
10 Position sensor
11 Signal
12 Hydraulic pump
13 Oil tank
14 Chilling cooler
15 Solenoid valve
16 Solenoid valve
17 Pilot check valve
18-1, 2 Restrictor valve
19 A-hydraulic circuit
20 Booster cylinder
21 Piston
22 Cylinder
23 Oil chamber
23-1 Oil chamber arranged opposite side of rod side oil chamber
24 Screw
25 Rod
26 Control motor
27 Accumulator
28 B-hydraulic circuit
30 Controlling driver device
31 Accumulator
32 Balance cylinder
33 Worm reducer
34 Driving motor
35 Screw-down screw
100 Hydraulic screw-down device
200 Small-size rolling mill or roll press machine
300 Housing (Rolling mill housing)
400 Metal plate

The invention claimed is:

1. A hydraulic screw-down device of a rolling mill that rolls a steel plate as a material to be rolled or of a roll press machine that roll-presses a material, wherein the rolling or the pressing is performed by giving roll force or pressing force between an upper roll and a lower roll by moving vertically a ram of a screw-down cylinder incorporated in a housing of the rolling mill or the roll press machine by pressure oil supplied from a hydraulic pump;

the hydraulic screw-down device comprising a booster cylinder;

a piston incorporated in the booster cylinder;

a rod, which has thread grooves on a surface thereof and is connected with the piston;

a controlling driver device comprising a controlling driver motor operably coupled to the rod, for controlling a range of piston movement;

an A-hydraulic circuit, which has a pilot check valve, for moving the ram vertically by pressure from the pressure oil supplied by operation of the hydraulic pump when the pilot check valve is open; and a B-hydraulic circuit, which is connected with the A-hydraulic circuit, for connecting the screw-down cylinder and the booster cylinder;

wherein when the pilot check valve is open, the pressure oil forms a first high-pressure state within the A-hydraulic circuit;

when the pilot check valve is closed, the hydraulic pump is isolated from supplying the pressure oil to move the ram and the pressure oil forms a second high-pressure state within the B-hydraulic circuit;

the controlling driver device produces a piston movement amount signal on the basis of a generated control-driving signal, wherein the piston movement is caused by rotatably engaging the thread grooves to cause the piston to make a controlled move, and performs pressure control of the high-pressure oil in the second high-pressure state to apply the pressure controlled roll force or pressing force on the ram;

thereby the roll force or the pressing force is given between the upper and lower rolls; and the material to be rolled is rolled or pressed.

2. The hydraulic screw-down device of the rolling mill or of the roll press machine according to claim 1, wherein the controlling driver device rotates the rod to control a rotational angle of the rod freely.

3. The hydraulic screw-down device of the rolling mill or of the roll press machine according to claim 1, wherein an accumulator is connected to an oil chamber located on a rod side of the booster cylinder.

4. A rolling mill or a roll press machine that has the hydraulic screw-down device according to claim 1, wherein, the screw-down cylinder is installed in a cylindrical recess provided on the top of the housing of the rolling mill or the roll press machine, the screw-down cylinder is fabricated so that the ram arranged inside the screw-down cylinder can move vertically, the booster cylinder is disposed on a top face of the housing of the rolling mill, and the screw-down cylinder and the booster cylinder are connected via the A-hydraulic circuit and the B-hydraulic circuit, above the rolling mill housing.

5. The rolling mill or the roll press machine according to claim 4, wherein the cylindrical recess is configured to receive a screw-down screw of an electric screw-down apparatus provided on the top of the housing of the rolling mill or the roll press machine.

6. A hydraulic screw-down device of a rolling mill that rolls a steel plate as a material to be rolled or of a roll press machine that roll-presses a material, wherein the rolling or the pressing is performed by giving roll force or pressing force between an upper roll and a lower roll by moving vertically a ram of a screw-down cylinder incorporated in a housing of the rolling mill or the roll press machine by pressure oil supplied from a hydraulic pump;

the hydraulic screw-down device comprising a booster cylinder;

a piston incorporated in the booster cylinder;

a rod, which has thread grooves on a surface thereof, connected with the piston;

a screw-engaging device that engages the thread grooves;

a controlling driver means comprising a controlling driver motor operably coupled to the rod via the screw-engaging device, for controlling a range of movement of the piston;

an A-hydraulic circuit, which has a pilot check valve, for moving the ram vertically by pressure from the pressure oil supplied by operation of the hydraulic pump when the pilot check valve is open; and a B-hydraulic circuit, which is connected with the A-hydraulic circuit, for connecting the screw-down cylinder and the booster cylinder;

wherein when the pilot check valve is open, the pressure oil forms a first high-pressure state within the A-hydraulic circuit;

when the pilot check valve is closed, the hydraulic pump is isolated from supplying the pressure oil to move the ram and the pressure oil forms a second high-pressure state within the B-hydraulic circuit;

the controlling driver device produces a piston movement amount signal on the basis of a generated control-driving signal, wherein the piston movement is caused by engaging the screw-engaging device with the thread grooves to cause the piston to make a controlled move, and performs pressure control of the high-pressure oil in the second high-pressure state to apply the pressure controlled roll force or pressing force on the ram;

thereby the roll force or the pressing force is given between the upper and the lower rolls; and the material to be rolled is rolled or pressed.

7. The hydraulic screw-down device of the rolling mill or of the roll press machine according to claim 6, wherein the controlling driver device rotates the rod by the engagement of the screw-engaging device with the thread groove to control a rotational angle of the rod freely.

8. The screw-down device of the rolling mill or of the roll press machine according to claim 6, wherein an accumulator is connected to an oil chamber located at a position opposite to an oil chamber on a rod side of the booster cylinder and an accumulator pressure of the accumulator is applied on the piston.

9. A rolling mill or a roll press machine that has the hydraulic screw-down device according to claim 6, wherein, the screw-down cylinder is installed in a cylindrical recess provided on the top of the housing of the rolling mill or the roll press machine;

the screw-down cylinder is fabricated so that the ram arranged inside the screw-down cylinder can move vertically;

the booster cylinder is disposed on a top face of the housing of the rolling mill; and the screw-down cylinder and the booster cylinder are connected via the A-hydraulic circuit and the B-hydraulic circuit, above the rolling mill housing.

10. The rolling mill or the roll press machine according to claim 9, wherein the cylindrical recess is configured to receive a screw-down screw of an electric screw-down apparatus provided on the top of the housing of the rolling mill or the roll press machine.

11. A method of hydraulic control using a hydraulic screw-down device of a rolling mill or of a roll press machine that rolls a steel plate as a material to be rolled or of a roll press machine that roll-presses a material, wherein the rolling or the pressing is performed by giving roll force or pressing force between an upper roll and a lower roll by moving vertically a ram of a screw-down cylinder incorporated in a housing of the rolling mill or the roll press machine by pressure oil supplied from a hydraulic pump; and the hydraulic screw-down device is comprised of a booster cylinder;

a piston incorporated in the booster cylinder;

a rod, which has thread grooves on a surface thereof and is connected with the piston;

a controlling driver device comprising a controlling driver motor operably coupled to the rod, for controlling a range of piston movement;

an A-hydraulic circuit, which has a pilot check valve, for moving the ram vertically by pressure from the pressure oil supplied by operation of the hydraulic pump when the pilot check valve is open; and a B-hydraulic circuit, which is connected with the A-hydraulic circuit, for connecting the screw-down cylinder and the booster cylinder;

wherein the method comprising:

forming a first high-pressure state with the pressure oil within the A-hydraulic circuit and the pilot check valve open;

closing the pilot check valve to isolate the hydraulic pump from supplying the pressure oil to move the ram;

forming a second high-pressure state with the pressure oil of high-pressure within the B-hydraulic circuit;

producing a piston movement amount signal on the basis of a controlling driving signal generated according to a position of the upper and the lower rolls to cause the piston to make a controlled move;

controlling a pressure of the high-pressure oil in the second high-pressure state;

applying a pressure controlled roll force or pressing force on the ram;

giving thereby the roll force or the pressing force between the upper and the lower rolls; and rolling or pressing the material to be rolled.

12. A method of hydraulic control using a hydraulic screw-down device of a rolling mill or of a roll press machine that rolls a steel plate as a material to be rolled or of a roll press machine that roll-presses a material, wherein the rolling or the pressing is performed by giving roll force or pressing force between an upper roll and a lower roll by moving vertically a ram of a screw-down cylinder incorporated in a housing of the rolling mill or the roll press machine by pressure oil supplied from a hydraulic pump; and the hydraulic screw-down device is comprised of a booster cylinder;

a piston incorporated in the booster cylinder;

a rod, which has thread grooves on a surface thereof and is connected with the piston;

a screw-engaging device that engages the thread grooves;

a controlling driver device comprising a controlling driver motor operably coupled to the screw-engaging device, for controlling a range of piston movement;

an A-hydraulic circuit, which has a pilot check valve, for moving the ram vertically by pressure from the pressure oil supplied by operation of the hydraulic pump when the pilot check valve is open; and a B-hydraulic circuit, which is connected with the A-hydraulic circuit, for connecting the screw-down cylinder and the booster cylinder;

wherein the method comprising:

forming a first high-pressure state with the pressure oil within the A-hydraulic circuit and the pilot check valve open;

closing the pilot check valve to isolate the hydraulic pump from supplying the pressure oil to move the ram;

forming a second high-pressure state with the pressure oil of high-pressure within the B-hydraulic circuit;

engaging the screw-engaging device and the thread grooves;

producing a piston movement amount signal for a controlled move of the piston in accordance with the engagement of the screw-engaging device and the thread grooves on the basis of a controlling driving signal generated according to a position of the upper and the lower rolls to cause the piston to make a controlled move;

controlling a pressure of the high-pressure oil in the second high-pressure state;

applying a pressure controlled roll force or pressing force on the ram;

giving thereby the roll force or the pressing force between the upper and the lower rolls; and rolling or pressing the material to be rolled.

13. A method of hydraulic control using a hydraulic screw-down device of a rolling mill or of a roll press machine that rolls a steel plate as a material to be rolled or of a roll press machine that roll-presses a material, wherein the rolling or the pressing is performed by giving roll force or pressing force between an upper roll and a lower roll by moving vertically a ram of a screw-down cylinder incorporated in a housing of the rolling mill or the roll press machine by pressure oil supplied from a hydraulic pump; and the hydraulic screw-down device is comprised of a booster cylinder;

a piston incorporated in the booster cylinder;

a rod, which has thread grooves on a surface thereof and is connected with the piston;

a controlling driver device comprising a controlling driver motor operably to the rod, for controlling a range of piston movement;

an A-hydraulic circuit, which has a pilot check valve, for moving the ram vertically by pressure from the pressure oil supplied by operation of the hydraulic pump when the pilot check valve is open; and a B-hydraulic circuit, which is connected with the A-hydraulic circuit, for connecting the screw-down cylinder and the booster cylinder;

wherein the method comprising:

forming a first high-pressure state with the pressure oil within the A-hydraulic circuit and the pilot check valve open;

closing the pilot check valve to isolate the hydraulic pump from supplying the pressure oil to move the ram;

forming a second high-pressure state with the pressure oil of high-pressure within the B-hydraulic circuit;

producing a piston movement amount signal on the basis of a controlling driving signal generated according to a position of the upper and the lower rolls to cause the piston to make a controlled move;

controlling a pressure of the high-pressure oil in the second high-pressure state;

applying the pressure controlled roll force or pressing force on the ram;

giving thereby the roll force or the pressing force between the upper and the lower rolls; and rolling or pressing the material to be rolled.

* * * * *